United States Patent [19]

Tamura

[11] Patent Number: 4,907,122

[45] Date of Patent: Mar. 6, 1990

[54] RELAY CIRCUIT HAVING A PULSE GENERATOR FOR CLOSING CONTACTS

[75] Inventor: Yoshiharu Tamura, Tokyo, Japan

[73] Assignee: NEC Corporation, Japan

[21] Appl. No.: 215,637

[22] Filed: Jul. 6, 1988

[30] Foreign Application Priority Data

Jul. 7, 1987 [JP] Japan ..... 62-170169

[51] Int. Cl.[4] ..... H01H 47/00

[52] U.S. Cl. ..... 361/186; 361/153; 361/168.1; 307/132 R

[58] Field of Search ..... 361/152, 153, 168.1, 361/169.1, 196, 197, 198, 186, 187; 307/130, 132 R, 132 E, 139, 140, 141

[56] References Cited

U.S. PATENT DOCUMENTS 3,965,398 6/1976 Miller ..... 361/198

4,710,645 12/1987 Doittau et al. ..... 307/132 R 4,714,976 12/1987 Pin et al. ..... 361/153

*Primary Examiner*—William M. Shoop, Jr.

*Assistant Examiner*—H. L. Williams

*Attorney, Agent, or Firm*—Laff, Whitesel, Conte & Saret

[57] ABSTRACT

In a relay circuit, a stationary contact of a relay is coupled to a DC voltage source and a moving contact of the relay is coupled to a load circuit. The moving contact is switched to the stationary contact in response to a rapidly rising edge of a DC voltage applied to the relay. A voltage sensor is connected to the moving contact for detecting a voltage which appears thereat. For operating the relay, a switch is closed to apply a voltage from the DC voltage source to a pulse generator. The pulse generator generates a rectangular pulse and applies it to the relay to cause it to switch the moving contact to the stationary contact. If a voltage is not detected by the voltage sensor at the moving contact after energization of the relay, the pulse generator reapplies a rectangular pulse to the relay until a voltage appears at the moving contact, whereupon the pulse generator applies a constant voltage to the relay.

3 Claims, 2 Drawing Sheets

RELAY CIRCUIT HAVING A PULSE GENERATOR FOR CLOSING CONTACTS

BACKGROUND OF THE INVENTION

The present invention relates to a relay circuit.

With conventional electromagnetic or solid-state relays, a DC voltage of a given polarity isapplied only once to the relay when operating it. With latching relays, a voltage of opposite polarity is applied to the relay when releasing it. If the relay fails to respond to a rapidly rising edge of the applied voltage for any reason, it is incapable of recovering from the failure and its contacts remain open or closed indefinitely. The same holds true if the relay, once operated, accidentally opens its contacts due to impact from an external source. Such accidental open contacts tend to occur frequently with the latching relays. A prior art attempt to avoid this problem involves the use of a resistor-capacitor circuit which is connected between the relay winding and a DC voltage source through a switch to absorb oscillatory currents generated by the vibratory movements, or "chattering", of the contacts of the switch when it is closed.

SUMMARY OF THE INVENTION

It is therefore an object of the present invention to provide a relay circuit in which a contact failure is detected either when a rapidly rising voltage is applied first or when the relay is already energized and the same voltage is reapplied when such conditions are detected.

Specifically, the relay circuit of the present invention comprises a relay having a stationary contact adapted to be coupled to a DC voltage source and a moving contact adapted to be coupled to a load circuit for switching the moving contact to the stationary contact in response to a rapidly rising edge of a DC voltage applied to the relay. A voltage sensor is connected to the moving contact of the relay for detecting a voltage which appears thereat. For operating the relay, a switch is closed to apply a voltage from the DC voltage source to a pulse generator. The pulse generator applies a rectangular pulse to the relay when a voltage is not detected by the voltage sensor in the presence of a voltage applied through the switch. If the voltage is not detected by the voltage sensor at the moving contact after energization of the relay, the pulse generator reapplies a rectangular pulse to the relay until a voltage appears at the moving contact. When a voltage is detected at the moving contact by the voltage sensor, the pulse generator applies a constant voltage to the relay.

In a practical aspect, the pulse generator includes a capacitor coupled through the switch to the voltage source. The pulse generator discharges the capacitor at periodic intervals to generate one or more rectangular pulses. The voltage sensor includes a circuit that establishes a short circuit across the capacitor to terminate its charging and discharging action when the voltage appears at the moving contact of the relay. A series circuit of a resistor and a diode is connected to the switch to apply current to the capacitor and a breakdown diode is coupled to the moving contact of the relay to detect a voltage thereat. A transistor is provided having a base connected to the breakdown diode and a collector connected to a junction between the resistor and diode to establish the short circuit across the capacitor when a current is supplied from the breakdown diode.

BRIEF DESCRIPTION OF THE DRAWINGS

The present invention will be described in further detail with reference to the accompanying drawings, in which.

DETAILED DESCRIPTION

Figure 1:
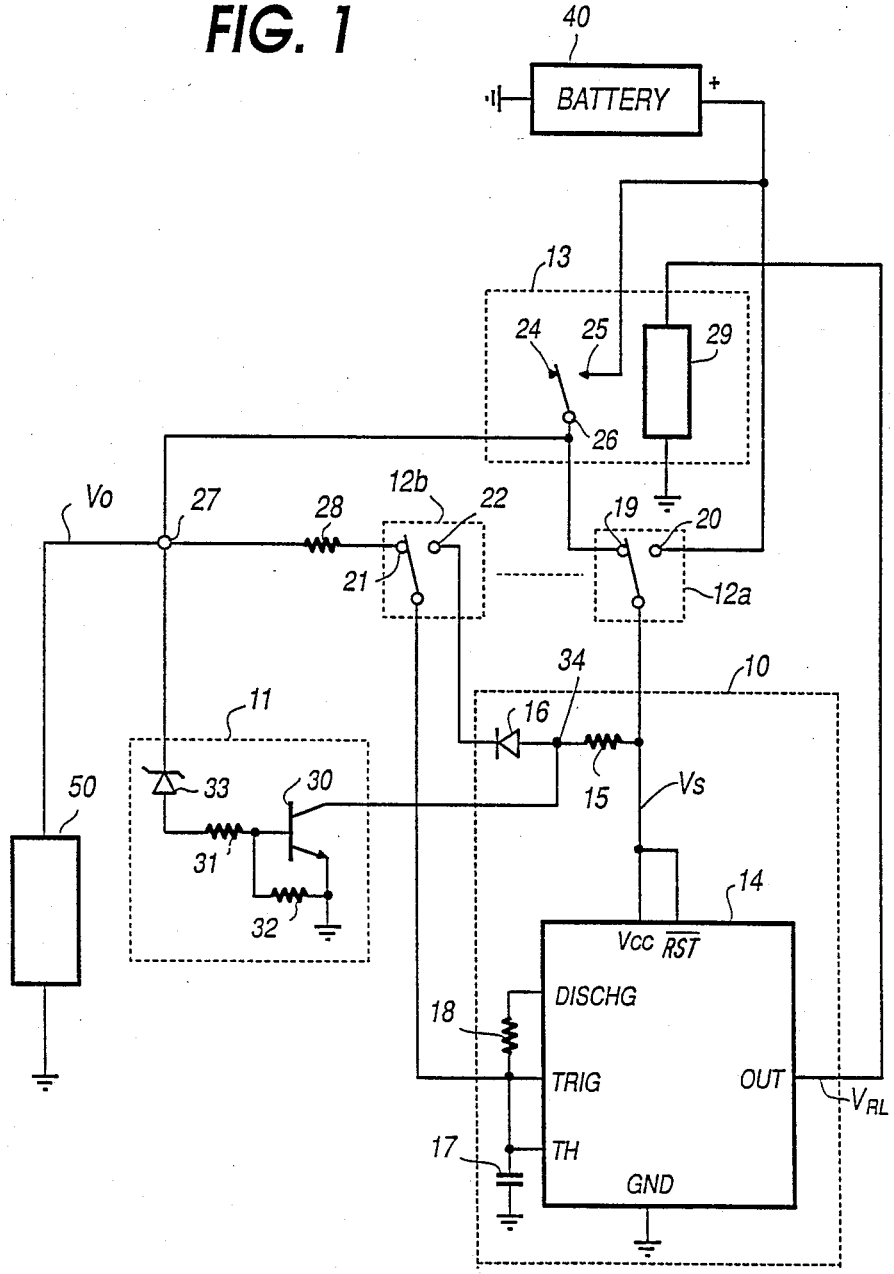
FIG. 1 is a circuit diagram of a relay circuit of the present invention.

Referring now to FIG. 1, there is shown a relay circuit of the present invention. The relay circuit generally comprises a pulse generator 10, a voltage sensing and oscillator disabling circuit 11, a pair of manually operated switches **12*a*, 12*b*, and an integrated circuit relay 13. Relay 13 has a moving contact 26 normally switched to an OFF position contact 24 and switched to an ON position contact 25 when operated to supply a positive potential from a battery 40 to an output terminal 27 to which a load circuit 50** is connected.

Pulse generator 10 comprises an integrated circuit oscillator 14, and a series circuit including a resistor 15 and a diode 16 whose cathode is connected to an ON position contact 22 of switch **12*b*. Diode 16 is poled to conduct current from the positive terminal of a battery 40 to charge a capacitor 17 when a voltage is not appearing at the moving contact 26. Capacitor 17 is coupled to the trigger input port of the integrated circuit 14 and is discharged through a resistor 18 to a discharge input port of the IC oscillator 14. The trigger input port of the oscillator 14 is connected to the moving contact of switch 12*b*. Switch 12*a* has an OFF position contact 19 coupled to the moving contact 26 of the relay and an ON position contact 20 coupled to the positive terminal of battery 40. Switch 12*b* has an OFF position contact 21 connected through a resistor 28 to the output terminal 27. The IC oscillator 14 has a voltage supply input port Vcc and a reset input port $\overline{RST}$ which are coupled together to one end of the resistor 15 and to the moving contact of switch 12*a*. The reset port $\overline{RST}$ is constantly supplied with a high voltage and responsive to a reset signal of low voltage level to clear the IC oscillator 14. Type μPC1555C available from the NEC Corporation is a suitable IC oscillator 14. The output port of oscillator 14 is connected to the contact operating circuit 29**.

Voltage sensing and oscillator disabling circuit 11 is formed by a switching transistor 30, resistors 31, 32 and a Zener diode 33. Transistor 30 has its collector connected to a junction 34 between resistor 15 and diode 16, with the emitter being connected to ground. The base of transistor 30, which is coupled to the anode of Zener diode 33 by resistor 31, is biased by a potential developed across resistor 32 when the breakdown diode 33 is conducting. The cathode of Zener diode 33 is connected to the moving contact 26 of the relay 13 to detect a voltage thereat.

Figure 2:
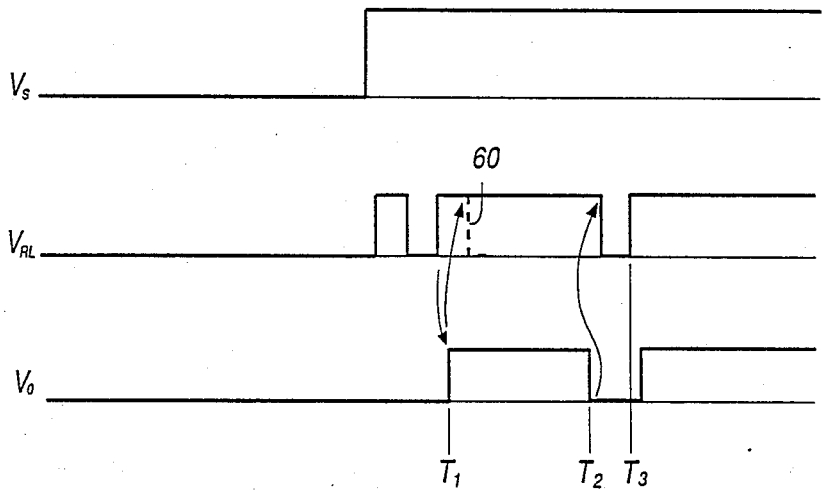
FIG. 2 is a diagram illustrating waveforms that appear in FIG. 1 when the relay is recovered after accidental open contacts.

When the relay 13 is not energized, the output terminal 27 is at zero voltage level and hence the Zener diode 33 is off and transistor 30 remains in an off state. Under this condition, the oscillator 14 is enabled. Operation of switches **12*a* and 12*b* from their OFF positions to ON positions causes a battery voltage Vs (see FIG. 2) to appear at the Vcc and reset ports $\overline{RST}$ of the IC oscillator 14 and a current to flow through resistor 15, diode 16 and switch 12b to the trigger input of oscillator 14, charging the capacitor 17 to develop a voltage at the trigger input. When the voltage at the trigger input port reaches a specified level, the oscillator 14 causes the capacitor 17 to be discharged through resistor 18 and charged again with the current from the battery. The process is repeated so that capacitor 17 is charged and discharged at periodic intervals. Thus, the output voltage $V_{RL}$ of oscillator 14 oscillates between high and low voltage levels and drives the contact operating circuit 29 of the IC relay 13. Moving contact 26 of the relay is switched to the ON position contact 25 in response to a rapid voltage rise at the second rising edge at time $T_1$, for example, due to inherent delay. The positive potential of battery 40 is therefore applied through the relay contact to the output terminal 27, supplying a voltage $V_o$ to the load circuit 50. The application of voltage $V_o$ at the output terminal 27 causes a current to flow through the Zener diode 33 and resistors 31 and 32 to ground, biasing the transistor 30 into a conductive state. Thus, the junction 34 between resistor 15 and diode 16 is driven to zero voltage level, terminating the charging current to the capacitor 17. As a result, oscillator 14 is stabilized and its output voltage $V_{RL}$ is kept at high level. The moving contact 26 thus remains switched to the ON position contact 25, continuously supplying the output voltage $V_o$ to the load circuit 50. If the moving contact 26 fails to respond to the second rising edge of the relay drive pulse, the charging operation will be continued and the oscillator output voltage $V_{RL}$ will fall again to the low voltage level, producing a second pulse as indicated by a dotted line 60 in FIG. 2. The oscillator will produce a third pulse to allow the relay 13** to respond to it.

Assume that the relay moving contact 26 switches to the OFF position contact 24 in response to an impact or the like at time $T_2$, the potential at the output terminal 27 falls to zero level and the Zener diode 33 and hence the transistor 30 is turned off, allowing the potential at the junction 34 to rise to a high level to resume the capacitor charging and discharging operation. Oscillator 14 is therefore triggered again to oscillates its output voltage $V_{RL}$, producing a rapid voltage rise at time $T_3$. If the energy produced by the oscillator 14 at this moment is sufficient to switch the moving contact 26 to the ON position contact 25, transistor 30 is again turned on to cease the charging of capacitor 17. If otherwise, the charge and discharge operation of capacitor 17 is repeated to oscillate the voltage $V_{RL}$ until the contact operating circuit 29 is supplied with sufficient energy to drive the contact 26.

Figure 3:
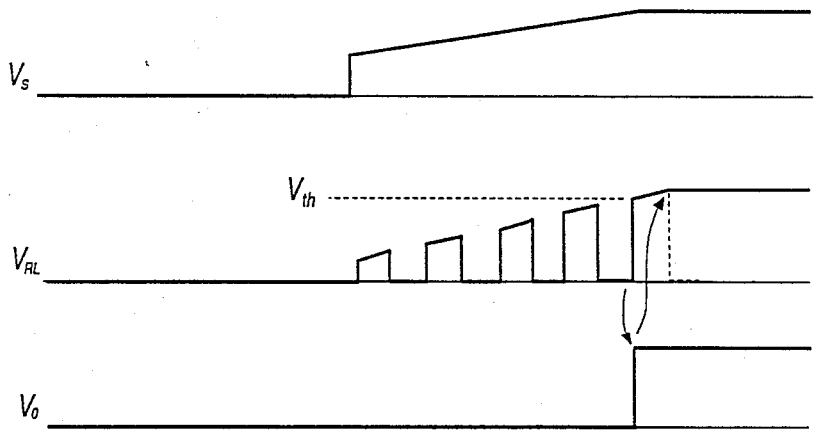
FIG. 3 is a diagram illustrating waveforms that appear in FIG. 1 when the relay is recovered when the battery is recharged after an accidental or excessive current drain.

Assume that the battery 40 has been accidentally or excessively drained during operation and the contact operating circuit 29 loses sufficient energy to keep the moving contact 26 switched to the ON position contact 25. If the battery 40 is recharged later so that its voltage begins to rise at time $T_1$(see FIG. 3), the gradual rise in voltage $V_S$ causes a current to flow through resistor 15 and diode 16 to capacitor 17 to reinitiate the oscillation of the output voltage $V_{RL}$. When the amplitude of the oscillation rises to a sufficient level $V_{th}$ at time $T_2$ for the relay 13, the moving contact 26 is switched again to the ON position contact 25 because of the impact energy produced by the rapid voltage rise at time $T_2$ and a voltage Vo will appear again at the output terminal 27.

It is seen therefore that the relay 13 is arranged to automatically receive impulses in repetition until its contacts are switched. Because of the high energy level of the impulse, the inherent inertia of the relay 13 can be easily overcome and the period of undesirable open conditions of the relay can be reduced to a minimum.

The foregoing description shows only one preferred embodiment of the present invention. Various modifications are apparent to those skilled in the art without departing from the scope of the present invention which is only limited by the appended claims. Therefore, the embodiment shown and described is only illustrative, not restrictive.

What is claimed is:

1. A relay circuit comprising:

a relay having a stationary contact adapted to be coupled to a DC voltage source and a moving contact adapted to be coupled to a load circuit for switching said moving contact to said stationary contact in response to a rapid rise in a voltage applied thereto;

voltage sensing means connected to said moving contact for detecting a voltage at said moving contact;

switch means connected to said DC voltage source; and pulse generating means for applying a pulse to said relay, in the presence of a voltage through said switch means, when a voltage is not detected by said voltage sensing means and applying a constant voltage to said relay when said voltage is detected by said voltage sensing means.

2. A relay circuit as claimed in claim 1, wherein said pulse generating means includes a capacitor coupled via said switching means to said DC voltage source and means for discharging said capacitor at periodic intervals and generating said pulse in response to a voltage developed in said capacitor, and wherein said voltage sensing means establishes a short circuit across said capacitor when said voltage appears at said moving contact.

3. A relay circuit as claimed in claim 2, further comprising a series circuit of a resistor and a diode connected between said switching means and said capacitor, wherein said voltage sensing means includes a breakdown diode coupled to said moving contact and a semiconductor switching means responsive to a current passed through said breakdown diode for establishing a short circuit from a junction between said diode and resistor to ground.

* * * * *